United States Patent [19]

Dahmen

[11] 4,218,426

[45] Aug. 19, 1980

[54] METHOD AND APPARATUS FOR THE COMBUSTION OF WASTE GASES

[75] Inventor: Karel R. Dahmen, Houston, Tex.

[73] Assignee: Continental Carbon Company, Houston, Tex.

[21] Appl. No.: 4,775

[22] Filed: Jan. 19, 1979

Related U.S. Application Data

[63] Continuation-in-part of Ser. No. 830,703, Sep. 6, 1977, abandoned, which is a continuation-in-part of Ser. No. 675,418, Apr. 9, 1976, abandoned.

[51] Int. Cl.[2] ..... B01D 53/34

[52] U.S. Cl. ..... 423/210; 110/345; 422/182; 422/183; 431/5; 431/9; 431/173

[58] Field of Search ..... 431/5, 9, 12, 116, 173; 110/264, 265, 275, 346, 341, 342, 344, 345; 422/182, 183; 423/210 C, 246, 245 R

[56] References Cited

U.S. PATENT DOCUMENTS

| | | | |
|---|---|---|---|
| 2,787,318 | 4/1957 | Wolfersperger | 431/9 |
| 3,105,540 | 10/1963 | Hardgrove | 431/173 |
| 3,179,150 | 4/1965 | Arnold | 431/173 |
| 3,215,501 | 11/1965 | Phillips | 422/183 |
| 3,396,681 | 8/1968 | Hubbard | 110/7 B X |
| 3,567,399 | 3/1971 | Altmann et al. | 110/8 A |
| 3,701,827 | 10/1972 | Dahmen | 422/183 |
| 3,837,813 | 9/1974 | Ebeling et al. | 431/116 X |
| 3,838,974 | 10/1974 | Hemsath | 423/210 C |
| 3,954,386 | 5/1976 | Harpenslager | 422/183 |

*Primary Examiner*—Earl C. Thomas
*Attorney, Agent, or Firm*—Jerry B. Peterson

[57] ABSTRACT

An improved waste gas cyclone combustor designed to operate with acceptable pressure losses when utilizing low calorific gases such as industrial waste gases of differing heating values. The improvement consists of the installation of one or more additional tangential inlet ports with valves which can be opened when the waste gas is of richer quality than the minimum quality for which the combustor is designed. Use of the additional port(s) reduces the inlet velocity which in turn reduces the inlet pressure drop losses to balance the increased chamber drag and outlet pressure drop resulting from the higher combustion temperature of the richer gas. This reduction in inlet velocity, when utilizing richer waste gases, is consistent with the fact that richer gases do not require swirl ratios as high as leaner gases. Therefore, the tangential inlet velocity can be reduced to the extent that the reduction in inlet pressure loss is about equal or even exactly equal to the increase in chamber drag and outlet pressure loss caused by the higher temperature and volume of the combustion products of the richer gas. Thus, a substantially balanced design is achieved with optimum aerodynamical combustion characteristics at minimum pressure loss. The invention is applicable, for example, to carbon black plant waste gases, which vary in calorific value depending upon what grade of carbon black is being produced.

1 Claim, 2 Drawing Figures

METHOD AND APPARATUS FOR THE COMBUSTION OF WASTE GASES

CROSS REFERENCE TO RELATED APPLICATIONS

This is a continuation-in-part of Ser. No. 830,703 filed Sept. 6, 1977, now abandoned, which in turn is a continuation-in-part of Ser. No. 675,418, filed Apr. 9, 1976, now abandoned.

BACKGROUND OF THE INVENTION

This invention relates to the combustion of industrial waste gases having relatively low calorific value, including but not limited to the combustion of waste gases produced in carbon black plants. Recovery of heat (hence energy conservation) and elimination of certain atmospheric pollutants are the desired objectives of this invention.

Disposal of such gases has presented many problems, the solutions for which have ranged from combustors where no supporting fuel is needed to sustain combustion, to those where supporting fuel, normally natural gas, is used to obtain ignition and complete combustion of the waste gas. These systems rely upon baffle walls and refractory checker work in the combustion zone to provide stabilization by heat radiating surfaces. They also rely upon long residence time in combustion chambers of large volume, preheating of combustion air and waste gas, and intensive mixing.

The rapid escalation of fuel prices and shortage of natural gas are strong incentives for development of combustion systems capable of efficiently burning low calorific value gases of varying composition. Using carbon black plant waste gases as an example, waste gases having calorific values varying from about 30–75 BTU/Ft.$^3$ are produced, depending upon the grade of carbon black being produced.

It is particularly desirable to eliminate the need for supplemental (supporting) fuel and to achieve high heat release rates so as to minimize combustor size.

It is also important to minimize the total pressure drop across the system due to the large fans and hence large amounts of power required to pressurize the system.

Cyclone combustors of cylindrical form utilizing a plurality of tangential inlet ports for air and fuel distributed over a substantial part of the length of the cylinder have desirable characteristics for waste gas combustion in that they combine a long residence time with the presence of an aerodynamic reverse-flow/recirculating zone near the outer refractory walls by which heat recirculates to one side of the flame front and heat radiates from the walls to the other side of the flame front. For example, see Agrest, J., "The Combustion of Vegetable Materials & Cotton Husk Combustion Problems," *J. Inst. Fuel,* Vol. 38, pp. 344–348, 1965; Schmidt, K. R. "The Rotary Flow Furnace of Siemens-Agrest," V.D.I.-Berichte, Vol. 146, pp. 90–101, 1970.

Preliminary experimental work utilizing a cyclone combustor for carbon black plant waste gases is described in a paper presented at the Apr. 21–22, 1975 Joint Meeting of Central and Western States Sections of the Combustion Institute: "The Combustion of Low Calorific Value Waste Gas," by K. R. Dahmen and N. Syred. In this cyclone combustor, the gas/air mixture enters a cylindrical combustion chamber or furnace through a plurality of tangential inlet ports and the outlet of the furnace is of smaller diameter than the diameter of the combustion chamber.

This invention is directed to an improvement on the cyclone combustor described in the Dahmen-Syred paper, whereby the aerodynamics of operation of the combustor can be adjusted so as to minimize the pressure losses across the system for waste gases of relatively low but varying calorific values.

The capability of such a device to burn gases with very low calorific value is improved by increasing the degree of swirl of the tangentially-flowing gases and also by decreasing the ratio of exit diameter to the combustion chamber diameter.

The beneficial effects of the above arrangements are diminished by considerable pressure drop over the system, and the improvements in combustion characteristics are sometimes hard to realize without incurring unacceptably high pressure losses.

Analysis of the pressure losses show that one part of these losses is directly related to the velocity in the tangential inlet ports, independent of conditions within the combustion chamber. This tangential inlet velocity is also an important factor in the magnitude of the Swirl Ratio. The Swirl Ratio is hereinafter quantified by Swirl Number, "S." The second part of the pressure losses is determined by the flow velocity in the furnace and especially in the restricted outlet.

If the furnace could be designed for a narrow range of waste gas quality, a combination of dimensions for inlets and outlets could be chosen to provide the optimum combustion characteristics commensurate with an acceptable pressure loss. In the majority of applications in a carbon black plant, however, waste gases having a wide range of qualities will have to be burned. The combustor will have to be designed for waste gas of the lower quality level with respect to tangential inlet velocity for Swirl Number and outlet velocity in the restricted exit throat. Such a design then will involve the highest acceptable system pressure drop. However, when grades of carbon black are produced which yield a waste gas of higher heating value, the temperatures in the furnace and in the outlet are much higher resulting in increased combustion chamber drag and outlet velocity, increasing the pressure drop significantly. As a result, the provisions to overcome the pressure losses have to be greater than would be required for the burning of the low calorific waste gas.

As suggested above, the leaner waste gases of very low calorific value require use of a higher Swirl Number than the richer waste gases having higher calorific values. Inasmuch as the Swirl Number is directly proportional to the tangential inlet velocity, the tangential inlet velocity can be reduced when richer gases are burned, thus reducing the inlet pressure losses so as to balance or substantially balance the increases in combustion chamber drag and outlet pressure loss. Such a balanced design not only increases efficiency but reduces capital investment by reducing the required maximum design capacity or capacity of the cyclone combustor and of the fans needed for pressurizing the system.

BRIEF SUMMARY OF THE INVENTION

This invention comprises a tangential inlet cyclone combustor, and method of operation, for burning industrial waste gases of low and varying calorific values, whereby the tangential inlet velocity can be varied so as to reduce such velocity when burning richer waste gases and to increase such velocity when burning leaner gases. A preferably method of reducing the tangential inlet velocity, for a given mass flow rate of waste gas and air (and, therefore, a given exit velocity of the combustion products), is to install one or more additional tangential inlet ports with valves which can be opened when richer waste gas is available. Optionally, these valves can be operated automatically using the exit temperature or—somewhat less desirable, using static pressure—as the controlling element.

As indicated above, the adjustment of the tangential inlet velocity can be made independent of the total mass flow rate and exit velocity. This means that the ratio of tangential inlet velocity to exit velocity can be changed without changing the total mass flow rate. This does not mean that the mass flow rate necessarily remains constant at all times, because the mass flow rate can be changed when required in order to change throughputs without interfering with the above ratio.

DESCRIPTION OF THE PREFERRED EMBODIMENTS

Figure 1:
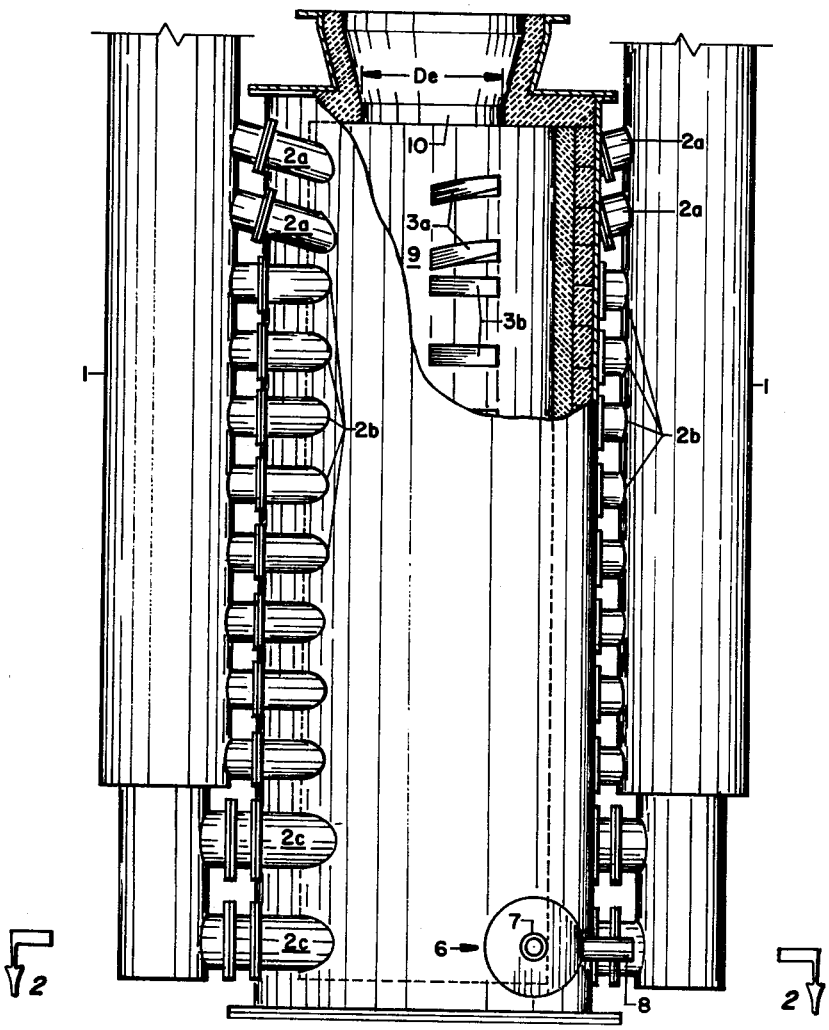
FIG. 1 is a longitudinal elevation, partly in section, of an apparatus embodying the invention.

Referring to FIG. 1, a mixture of waste gas and air enters header 1 and passes tangentially into the combustion chamber or incinerator 9 through a plurality of pipes 2 (2*a*, 2*b* and 2*c*). Alternately, the combustion air could be mixed with the waste gases at other locations, for example through pipes (now shown) connected to the inlet pipes 2.

Preferably, there are two rows of pipes 2 and inlets 3 (3*a*, 3*b* and 3*c*) separated by at least 90° on the circumference of the circular section of the combustor but preferably diametrically opposed.

Optionally, at least the pair of pipes 2*a* and inlets 3*a* nearest to the combustor outlet are inclined as shown, in order to give an upstream direction to the flow of the incoming mixture. Inlets 3 may be rectangular (as shown) or circular.

One or more pipes 2*c* are equipped with flow control means such as butterfly valves 4 for reasons (explained below) relating to the crux of the invention.

Purely as a matter of engineering design, the portion of header 1 supply pipes 2*c* can be of reduced diameter.

Although the combustor 9 in FIG. 1 in vertically-positioned, it could alternately be horizontally-oriented.

Auxiliary burners 6 are included for the combustion of auxilliary fuel (liquid or gas supplied through pipes 7) as and when needed to initiate combustion of the waste gases or to sustain combustion when the calorific value of the gases is temporarily decreased due to upsets in the production of these gases. Air for combustion of the auxiliary fuel is introduced through pipe(s) 8.

The mixture of gas and air, upon entering through the tangential inlets 3 is in rotational motion. At increased radial distance from the wall towards the center, the rotational velocity increases to a maximum which can be as high or higher than two times the velocity close to the cylinder wall. This maximum is located at about two-thirds the radial distance from wall to center. From this location towards the center, the rotational velocity rapidly declines to approximately zero. Along the cylindrical wall, over approximately two-thirds of the length of the combustor, a thin annulus of axially reversed flow, that is away from the discharge end, recirculates hot combustion products into the incoming flow of gas and air, whereby ignition is first established in this annulus and combustion is supported by radiation from the glowing refractory of the adjacent wall face. Ignition then proceeds from this outer annulus to the inner region of the combustor resulting in stable burning of the entire inner volume of the combustor.

The combustion products then exit the combustor through the restricted outlet 10, and pass to a stack (not shown) or to heat recovery means (not shown) such as a boiler.

The combustor is equipped with refractory and insulating firebrick.

As indicated above, for burning waste gases of low calorific value, a high tangential inlet velocity through inlets 3 is needed, in combination with a reduced-diameter exit (outlet 10). A high ratio of tangential inlet velocity to axial outlet velocity provides the required high degree of swirl, as expressed by the Swirl Number "S". The amount of reduction of the exit diameter is expressed as the ratio of $D_e$ (exit diameter, i.e. diameter at 10) to the diameter $D_o$ of combustion chamber 9. This ratio $D_e/D_o$ should be designed for about 0.2–0.75 depending upon the ranges of composition of the waste gases.

The Swirl Number "S", used herein as a nondimensional criterion to characterize and to control the aerodynamic behavior in a cyclone combustor of this type, is the ratio of the moment about the central axis of the tangential inlet momentum to the product of the axial thrust in the discharge opening and the exit radius.

The calculation of the Swirl Number "S" for the operational conditions listed in Example 1 of page 10 is as follows:

A. Tangential Inlet Flow

The tangential inlet momentum is the product of the Mass Flow "$M_t$" (gas and air) and Velocity "$V_t$"

$$M_t = 20.22 \text{ Lbs./Sec.}$$
$$V_t = \frac{\text{Flowing Volume}}{\text{Tangential Inlet Area}} = \frac{446.6}{3.265} = 136.8 \text{ Ft./Sec.}$$
$$M_t \times V_t = 2{,}766 \text{ (Lbs.)(Ft.)/Sec.}^2$$

The radius of the combustor = 3.75 Ft.

Therefore, the moment of the tangential inlet momentum about the central axis = 2,766 × 3.75 = 10,373 (Lbs.)(Ft.)$^2$/Sec.$^2$.

B. Outlet Flow

The axial thrust is the product of the Mass Flow of the exit products "$M_e$" and the Exit Velocity "$V_e$"

$$M_e = 20.22 \text{ Lbs./Sec.}$$
$$V_e = \frac{\text{Flowing Volume}}{\text{Outlet Area}} = \frac{1{,}219}{11.04} = 110.37 \text{ Ft./Sec.}$$
$$M_e \times V_e = 2{,}232 \text{ (Lbs.)(Ft.)/Sec.}^2$$

The radius of the exit opening is 1.875 Ft.

The product of outlet thrust and radius = 4,185 (Lbs.)(Ft.)$^2$/Sec.$^2$.

Therefore, the Swirl Number "S" = 10,373/4,185 = 2.48.

It has been found that for burning lean waste gases of very low calorific value (30–45 BTU/Ft.$^3$) in a cyclone combustor, a favorable combination is "S" in the range of about 1.6–2.5, preferably 2.5. For such an operation the butterfly valves 4 are closed, thus providing for the tangential inlet velocity required to obtain the above swirl through inlets 3.

When burning richer waste gases of higher calorific value (46–75 BTU/Ft.$^3$), the increased volume of resulting combustion products increases the total pressure losses by increasing the combustion chamber drag and the pressure drop across the restricted-diameter outlet 10. When burning richer gases, therefore, butterfly valves 4 are opened, thus reducing the inlet velocities at the openings from pipe 2 into chamber 3 and therefore reducing the inlet pressure losses to balance the increased chamber drag and outlet pressure drop. This is consistent with the fact that the Swirl Number may be reduced to 1.0–1.5 when richer gases are burned.

If the differences in calorific values varies by greater amounts, additional velocity-reducing inlet pipes 2c can be used.

EXAMPLES

Typical waste gases from the production of two grades of carbon black have the following approximate compositions:

| | Mole Percent | |
|---|---|---|
| | Example 1 | Examples 2–4 |
| $H_2$ | 5.67 | 7.80 |
| A | 0.43 | 0.43 |
| $CO_2$ | 2.96 | 2.61 |
| $N_2$ | 37.51 | 35.27 |
| $C_2H_2$ | 0.43 | 0.43 |
| $CH_4$ | 0.24 | 0.27 |
| CO | 5.76 | 6.19 |
| $H_2O$ | 47.00 | 47.00 |
| Calorific Value, BTU/Ft.$^3$ Net | 42.55 | 50.05 |

Figure 2:
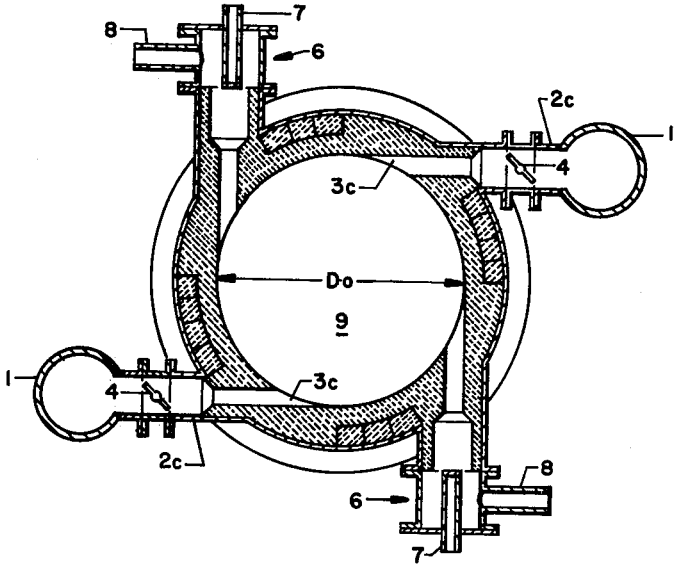
FIG. 2 is a sectional view taken along the line 2—2 of FIG. 1 and illustrating one pair of tangential ports for the entry of waste gas and air and in addition a suitable arrangement of ignition/support burners utilizing natural gas or fuel oil.

The apparatus of FIGS. 1 and 2 is operated using the following dimensions and conditions to obtain the following results, using the waste gases described above:

| | Examples | | | |
|---|---|---|---|---|
| | 1 | 2 | 3 | 4 |
| Length of combustor, Ft. | 18.75 | 18.75 | 18.75 | 18.75 |
| $D_o$, Ft. | 7.5 | 7.5 | 7.5 | 7.5 |
| $D_e$, Ft. | 3.75 | 3.75 | 3.75 | 3.75 |
| Entry Products: | | | | |
| Waste Gas-calorific value, net BTU/SCF | 42.55 | 50.05 | 50.05 | 50.05 |
| -quantity, SCF/Sec. | 233.7 | 233.7 | 233.7 | 233.7 |
| Air -quantity, SCF/Sec. | 87.8 | 102.9 | 102.9 | 102.9 |
| Density of mix, Lbs./SCF | 0.0629 | 0.0635 | 0.0635 | 0.0635 |
| Mass Flow, Lbs./Sec. | 20.22 | 21.37 | 21.37 | 21.37 |
| Flowing pressure (design), inches W.C. | 8 | 8 | 8 | 8 |
| Flowing temperature, °F. | 280 | 280 | 280 | 280 |
| Flow volume, CF/Sec. | 446.6 | 469.7 | 469.7 | 469.7 |
| Exit Products: | | | | |
| Quantity, SCF/Sec. | 310.3 | 319.8 | 319.8 | 319.8 |
| Density, Lbs./SCF | 0.0652 | 0.0668 | 0.0668 | 0.0668 |
| Mass Flow, Lbs./Sec. | 20.22 | 21.37 | 21.37 | 21.37 |
| Exit Products (continued): | | | | |
| Flowing pressure, inches W.C. | 3.5 | 6 | 6 | 6 |
| Flowing temperature, °F. | 1600 | 2050 | 2050 | 2050 |
| Flow volume, CF/Sec. | 1219 | 1536 | 1536 | 1536 |
| Outlet velocity, Ft./Sec. | 110.37 | 139.107 | 139.10 | 139.10 |
| Swirl Number, S | 2.48 | 2.48 | 2.07 | 1.5 |
| Requires: | | | | |

-continued

| | Examples | | | |
|---|---|---|---|---|
| | 1 | 2 | 3 | 4 |
| Tangential inlet velocity, Ft./Sec. | 136.8 | 173.88 | 143.86 | 104.32 |
| Hence: | | | | |
| Tangential inlet area, Ft.$^2$ | 3.265 | 2.701 | 3.265 | 4.5 |
| Pressure drop: | | | | |
| Inlet, inches W.C. | 3.50 | 5.78 | 3.95 | 2.08 |
| Chamber & outlet, Inches W.C. | 4.40 | 5.82 | 5.82 | 5.82 |
| TOTAL | 7.90 | 11.60 | 9.77 | 7.90 |

Explanatory notes

EXAMPLE 1

The system is designed in accordance with Example 1 to burn waste gas of 42.55 BTU/SCF Net at a Swirl Number of S=2.48. For the given dimensions of the combustor this would require a total area of tangential inlet ports 3 of 3.265 Ft.$^2$. This could be provided satisfactorily by two rows of ten openings 3, each 4.5 inches×5.25 inches, connected to six-inch pipes 2. The pressure drop for this system is 7.9 inches W.C.

EXAMPLE 2

Due to the higher temperature resulting from burning gas of 50.05 BTU Net and a slightly higher air to gas ratio required to burn the richer gas, the exit velocity is increased substantially. If one would insist on maintaining the same swirl S=2.48, the inlet velocity would also have to be increased. This would result in increased pressure drop in the tangential inlets as well as over the combustion chamber and outlet adding up to 11.6 inches W.C. These conditions would be essentially satisfied by closing two pipes 3 in each row. However, there would be no incentive to do so inasmuch as this gas will burn at lower swirl number.

EXAMPLE 3

When the inlet area is maintained equal to Example 1, the swirl number is reduced to S=2.07, when burning the 50.05 BTU gas. The pressure drop for this arrangement is 9.77 inches W.C., which is higher than the design for Example 1.

EXAMPLE 4

By reducing the swirl number to S=1.5, the pressure drop can be reduced to the same value as for Example 1. This would require adding 1.235 Ft.$^2$ tangential inlet area which can be done by opening valves in 8-inch diameter supply pipes 2c to four openings 3c each $7\frac{1}{4}''$-$\times 6\frac{1}{8}''$.

The foregoing description and examples should not be considered limitative. To those skilled in the art, many variations will be apparent depending upon the volume and composition of waste gases as well as the sizes and types of equipment upstream and downstream of the combustor.

I claim:

1. The method of combusting industrial waste gases of varying calorific values in the range of 30–75 BTU/Ft.$^3$ comprising the steps of:

introducing a mixture of said gases and air into a cyclone combustor through a plurality of inlets tangential with respect to the inside wall of said combustor;

causing said mixture to burn;

passing the gaseous combustion products through an outlet of diameter of about 0.2–0.75 of the diameter of said combustor;

varying the tangential inlet velocity, for a given mass flow rate, by changing the number of tangential inlets by opening or closing flow control means in at least one of said inlets, so as to reduce said velocity when burning waste gases of relatively higher calorific values of 46–75 BTU/Ft.$^3$ and to increase said velocity when burning waste gases of lower calorific values of 30–45 BTU/Ft.$^3$, so as to substantially balance the overall pressure losses across said inlets, combustor and outlet; and utilizing a Swirl Number of about 1.0–1.5 when burning said higher calorific value gases and a Swirl Nunber of about 1.6–2.5 when burning said lower calorific value gases.

* * * * *